US009139995B2

(12) United States Patent
Escudero et al.

(10) Patent No.: US 9,139,995 B2
(45) Date of Patent: Sep. 22, 2015

(54) TOILET OVERSPRAY SHIELD AND FUNNEL

(76) Inventors: Norma Escudero, Helotes, TX (US); Jorge Escudero, Helotes, TX (US)

( * ) Notice: Subject to any disclaimer, the term of this patent is extended or adjusted under 35 U.S.C. 154(b) by 651 days.

(21) Appl. No.: 13/092,742

(22) Filed: Apr. 22, 2011

(65) Prior Publication Data

US 2012/0096633 A1 Apr. 26, 2012

Related U.S. Application Data

(60) Provisional application No. 61/327,548, filed on Apr. 23, 2010.

(51) Int. Cl.
*E03D 9/00* (2006.01)

(52) U.S. Cl.
CPC ..... *E03D 9/00* (2013.01)

(58) Field of Classification Search
CPC ..... E03D 9/00; E03D 13/00; A47K 13/24; Y10S 4/05
USPC ..... 4/300.3, 301, DIG. 5, 902; D23/307, D23/309, 310, 311; 141/331–345
See application file for complete search history.

(56) References Cited

U.S. PATENT DOCUMENTS

| | | | | |
|---|---|---|---|---|
| D110,120 | S | 6/1938 | Kraus | |
| 2,583,718 | A * | 1/1952 | Walls | 4/661 |
| 2,980,919 | A | 10/1957 | Otto et al. | |
| 3,350,722 | A * | 11/1967 | Moreschini | 4/300.3 |
| 3,914,803 | A | 10/1975 | Gregovski | |
| D245,425 | S | 8/1977 | Annis | |
| D262,648 | S | 1/1982 | Lemmon | |
| 5,077,840 | A | 1/1992 | Masters et al. | |
| 5,117,512 | A | 6/1992 | Bressler | |
| 5,216,760 | A * | 6/1993 | Brown et al. | 4/300.3 |
| 5,465,431 | A | 11/1995 | Wertz | |
| 5,564,135 | A | 10/1996 | Jones et al. | |
| 5,662,630 | A * | 9/1997 | Raynie | 604/349 |
| D394,900 | S | 6/1998 | Kang | |
| 5,815,851 | A | 10/1998 | Perry | |
| D409,736 | S | 5/1999 | Koehn | |
| 5,966,748 | A * | 10/1999 | Young et al. | 4/144.4 |
| 5,983,410 | A | 11/1999 | Webster | |
| 6,032,302 | A | 3/2000 | Eckert | |
| 6,357,055 | B1 | 3/2002 | Gambla et al. | |
| 6,385,785 | B1 | 5/2002 | Linden | |
| D458,669 | S * | 6/2002 | Sanders | D23/307 |
| 6,763,531 | B1 * | 7/2004 | Huffman et al. | 4/251.1 |
| 6,874,171 | B2 | 4/2005 | Erves | |
| 6,938,860 | B2 * | 9/2005 | Singleton | 248/99 |
| 7,007,313 | B1 * | 3/2006 | Johnson | 4/300.3 |
| 7,017,198 | B2 | 3/2006 | Conn et al. | |

(Continued)

*Primary Examiner* — Paul R Durand
*Assistant Examiner* — Christine Skubinna
(74) *Attorney, Agent, or Firm* — Kammer Browning PLLC

(57) ABSTRACT

A funnel device to assist individuals, especially males, with the standing use of toilet facilities. The funnel is used to contain any urine overspray from an individual standing in front of a toilet. The device may be easily placed and positioned on, or removed from, the toilet. The device is a truncated cone of flexible plastic material, with a large V-shaped space formed in one side. The narrow end of the cone is inserted into the toilet and is sized to extend into the toilet basin. The device is preferably constructed from a sheet of heavy flexible plastic, attached back onto itself at a point near the narrow end of the cone. Holes near the base may be incorporated to allow water to flow into the cone from the toilet bowl. Handle cutouts may be positioned near the upper perimeter of the cone to facilitate placement of the device.

11 Claims, 5 Drawing Sheets

(56) References Cited

U.S. PATENT DOCUMENTS

| | | | | |
|---|---|---|---|---|
| 7,043,773 | B2 | 5/2006 | McAleenan, Jr. | |
| 7,178,177 | B1 * | 2/2007 | Valencia | 4/300.3 |
| 2004/0237181 | A1 | 12/2004 | Atkins-Williams | |
| 2005/0193482 | A1 | 9/2005 | Gambla et al. | |
| 2006/0041998 | A1 | 3/2006 | Lattanzi | |
| 2008/0103422 | A1 * | 5/2008 | Perry et al. | 601/150 |
| 2009/0089919 | A1 * | 4/2009 | Rudolph | 4/144.4 |

* cited by examiner

TOILET OVERSPRAY SHIELD AND FUNNEL

CROSS REFERENCES TO RELATED APPLICATIONS

This application claims the benefit under Title 35 United States Code §119(e) of U.S. Provisional Patent Application Ser. No. 61/327,548; filed Apr. 23, 2010; the full disclosure of which is incorporated herein by reference.

BACKGROUND OF THE INVENTION

1. Field of the Invention

The present invention relates generally to devices for assisting individuals with the use of toilet facilities. The present invention relates more specifically to a funnel device configured to assist male individuals, especially young male individuals, with the standing (as opposed to seated) use of toilet facilities.

2. Description of the Related Art

There are many devices designed to assist individuals with using toilet facilities. Most devices in this field have focused on assisting individuals with movement to and from a seated position on a toilet. Other devices provide elevated toilet seats that allow individuals to use the toilet facility without the necessity of moving to a low seated position. While the present invention is concerned with assisting individuals with the use of toilet facilities, its focus is on improving such use by male individuals standing in front of a toilet.

While most all male individuals must take some care in using a toilet from a standing position, some male individuals, especially young boys, often find it quite difficult to fully confine the stream of urine to the narrow opening of the toilet bowl. Some individuals with special needs involving muscle control, stability, and balance may have an even more difficult time directing and confining urine within the perimeter of the toilet bowl.

Efforts that have been made in the past to address the above described problems have fallen short for a number of reasons. Most suffer from cost and complexity issues and are simply too expensive to manufacture and purchase. Others fail because they are difficult to place and position in the toilet bowl or are designed to remain in place to be collapsed or moved to the side to allow seated use of the toilet. There is a need for a simple, easily removable, toilet splash guard that is low in cost, easy to clean, and requires no tools to install or remove. It would be desirable if the splash guard could be easily manufactured from inexpensive (but still rugged) materials. It would be desirable if the splash guard provided a safe but effective means for fully containing urine overspray within the confines of the toilet bowl.

SUMMARY OF THE INVENTION

In fulfillment of the above stated objectives the present invention provides a device configured to assist male individuals, especially young male individuals, with the standing (as opposed to seated) use of toilet facilities. The device of the present invention is a funnel for containing any urine overspray from a male individual standing in front of a toilet, especially a young male child who might have difficulty directing the urine stream into the toilet. Key elements of the device include its simplicity of construction, its large size, and its ease of placement on the toilet. The device comprises a truncated cone of flexible plastic material, such as might be used to construct a heavy duty waste basket or the like, with a large V-shaped space formed in one side of the cone. The narrow end of the truncated cone is inserted into the toilet and is sized so as to extend to some distance into the toilet basin or bowl. The device may preferably be constructed from a large, approximately rectangular sheet of heavy flexible plastic that is formed into a cone and attached back onto itself at a point near the narrow end of the truncated cone.

Additional optional features include the placement of an array of holes near the base of the truncated cone (the lower end of the device) that would allow water to flow into the cone from the toilet bowl in a manner that would facilitate rinsing of the cone after use. A removable cup may also be positioned in the vertex of the V-shaped cutout from the side of the cone to collect any urine that may drip during use. Finally, handle cutouts may be positioned near the upper perimeter of the cone to facilitate placement and removal of the device in the toilet. In the ideal environment, the device may be alternately maintained in the toilet or in an adjacent bathtub or shower where it may be rinsed in between uses. Once again, the goal of the invention is to create a simple, inexpensive to manufacture, structure that is highly functional and effective in containing urine overspray and directing into the toilet bowl.

DETAILED DESCRIPTION OF THE PREFERRED EMBODIMENTS

Figure 1:
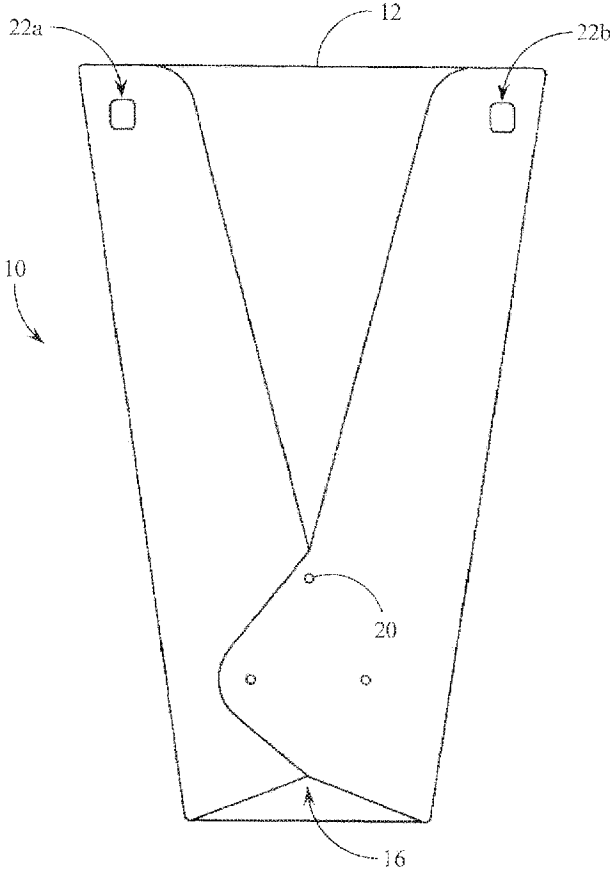
FIG. 1 is a front elevational view of the overspray shield and funnel device of the present invention, shown in its assembled configuration.

As summarized above, the device of the present invention is a funnel for catching and containing any urine overspray from a male individual standing in front of a toilet, especially a young male child who might have difficulty directing the urine stream into the toilet. FIG. 1 is a front elevational view of the overspray shield and funnel device of the present invention, shown in its assembled configuration. Overspray shield 10 is a large cone shaped device preferably constructed of a single plastic sheet or panel 12 that is cut according to a predetermined pattern and then rolled into the cone shape shown and attached back onto itself near the lower end of the cone. This construction creates a wide top opening 14 and a narrower bottom opening 16. The base corners of the plastic sheet 12 are overlapped at section 18 and are attached to one another in this position using rivets 20, or some similar means for attachment. This means for attachment to create the cone shape may be permanent (such as with rivets) or removable (such as with snaps). The attachment means is preferably non-corrosive (such as with nylon rivets or snaps) and may comprise chemical adhesive bonding or thermal welding. The cone thus created may preferably be about two to three feet tall, about one to one and a half feet wide at the base, and about two feet wide at the top.

The material from which the flexible sheet or panel is constructed may vary. In the preferred embodiment a relatively heavy gauge low-density polyethylene (LDPE) plastic, such as is used for the manufacture of plastic waste baskets and the like, is utilized. The key characteristics are liquid impermeability and semi-rigid flexibility. Currently, many plastic compositions are impregnated with antimicrobial compositions and/or deodorizing chemicals. It is anticipated that the present invention lends itself to the utilization of one or more of these types of chemical additives to the plastic panel used to construct the funnel walls of the present invention. The present invention also lends itself to being constructed from various types of recycled plastic materials.

Figure 2:
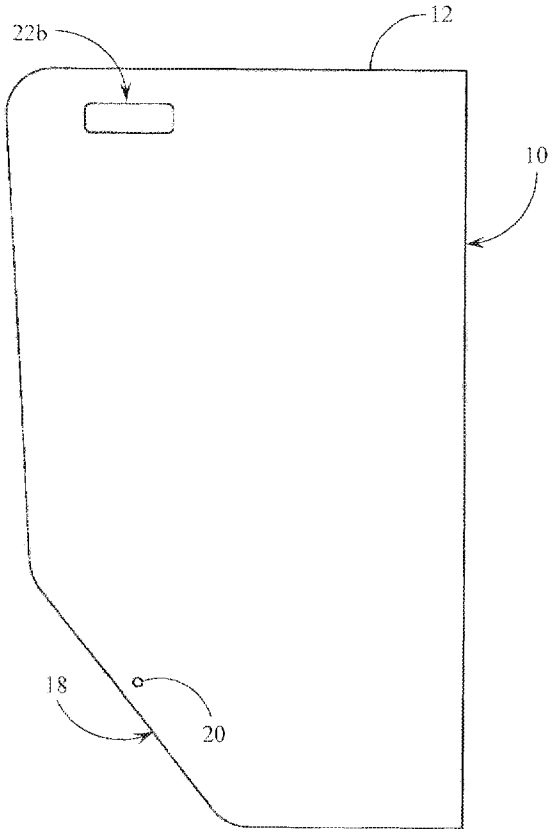
FIG. 2 is a side elevational view of the overspray shield and funnel device of the present invention, shown in its assembled configuration.

FIG. 2 is a side elevational view of the overspray shield and funnel device of the present invention, again shown in its assembled configuration. In this view (and in the view of FIG. 1) the means for handling the device can be seen. Handle apertures 22*a* & 22*b* are positioned near the top edge of the device (removed from the region of overspray) and facilitate the placement and removal of the device into and out of the toilet as described in more detail below. The view of FIG. 2 also shows the manner in which the upper sides of the device extend forward to come close to either side of the user. The manner of overlapping the lower corners in section 18 achieves this funnel shape with upper side panels to create the V-shaped opening best seen in FIG. 1. This arrangement keeps hand holds 22*a* & 22*b* up and out of the way.

Figure 3:
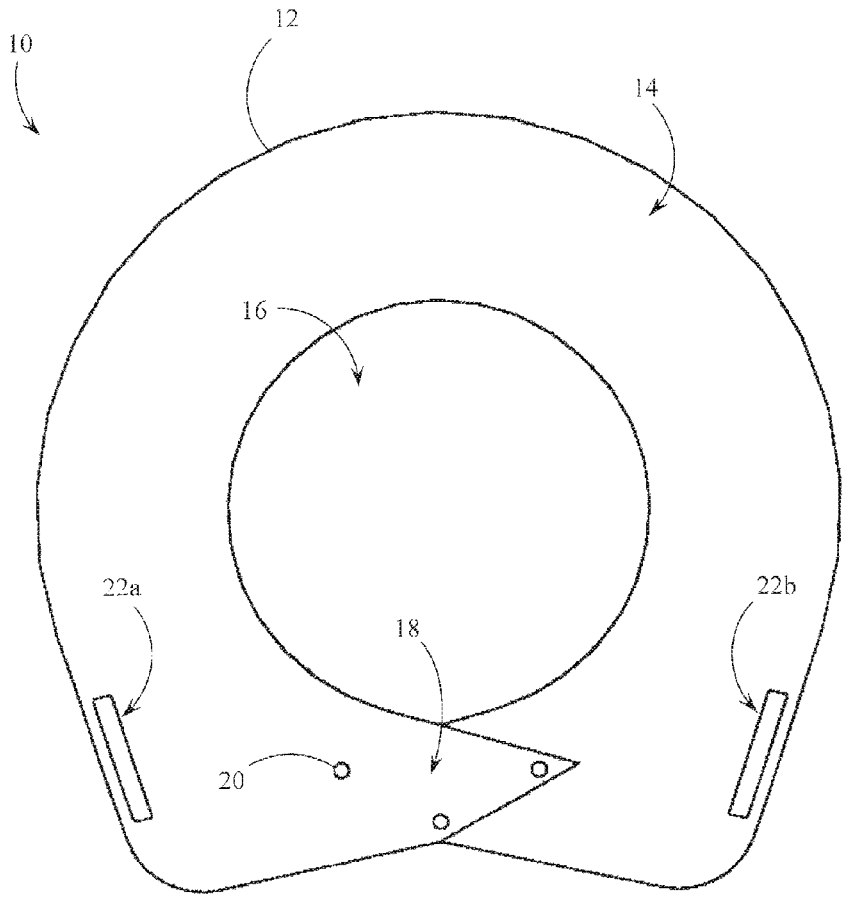
FIG. 3 is a top plan view looking down into the overspray shield and funnel device of the present invention, shown in its assembled configuration.

FIG. 3 is a top plan view looking down into the overspray shield and funnel device of the present invention, again shown in its assembled configuration. In this view it can be seen how the upper opening 14 is larger than the lower opening 16 thereby creating the funnel shape. In this interior view it can be seen how the inside corner overlaps in section 18 and the various attachment members (rivets) secure the corners in place.

Figure 5:
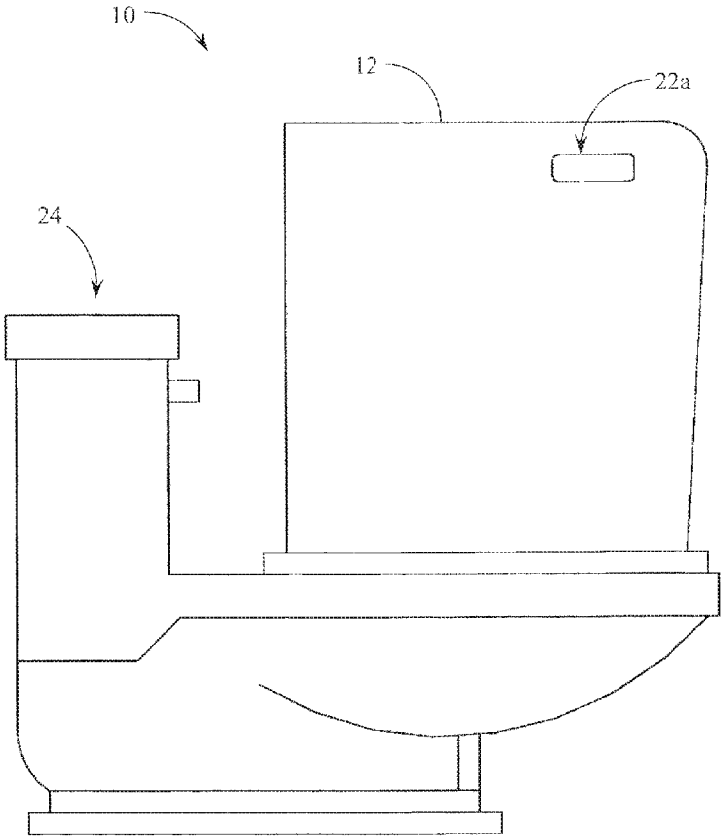
FIG. 5 is a side elevational view of the overspray shield and funnel device of the present invention, shown positioned into a typical toilet bowl for use.
Figure 4:
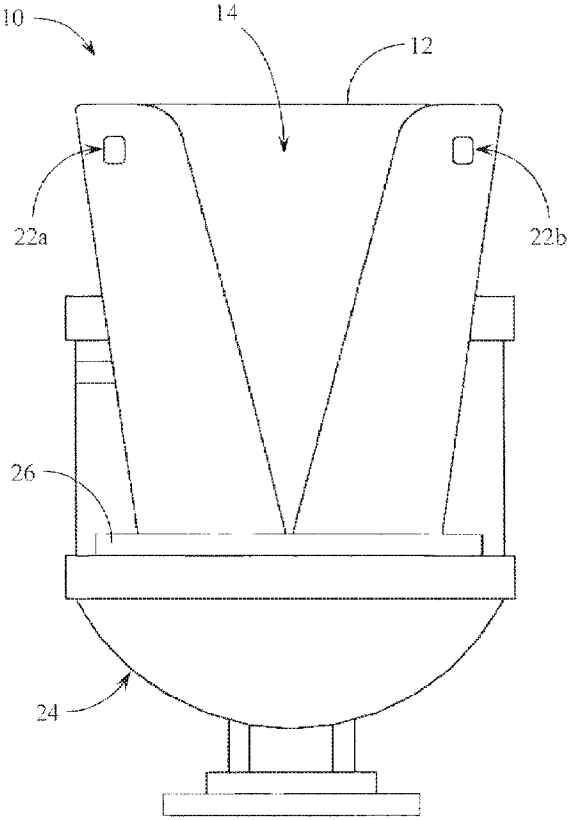
FIG. 4 is a front elevational view of the overspray shield and funnel device of the present invention, shown positioned into a typical toilet bowl for use.

FIG. 4 is a front elevational view of the overspray shield and funnel device of the present invention, shown positioned into a typical toilet bowl for use. In this view, overspray shield 10 is positioned in toilet 24 in an orientation appropriate for use. As shown in FIG. 4, the size of the device 10 is such that the vertex of the V-shaped opening is positioned at or just below the top edge of the toilet or the edge of the toilet seat. In this manner, a young boy standing at the toilet would find himself at just the right height to direct the urine flow into the confines of the funnel. The bottom edge of the device sits firmly on the bottom/side surfaces of the bowl of the toilet to support the device in a generally upright position. FIG. 5 is a side elevational view of the overspray shield and funnel device of the present invention, again shown positioned into a typical toilet bowl for use. In this view it can be seen how the front edges of the shield extend forward to the front of the bowl while still allowing for the V-shaped opening to allow access by the user. Once again, handles 22*a* & 22*b* are positioned up and out of the way during use but are readily reachable for the removal of the overspray shield after use.

Figure 6:
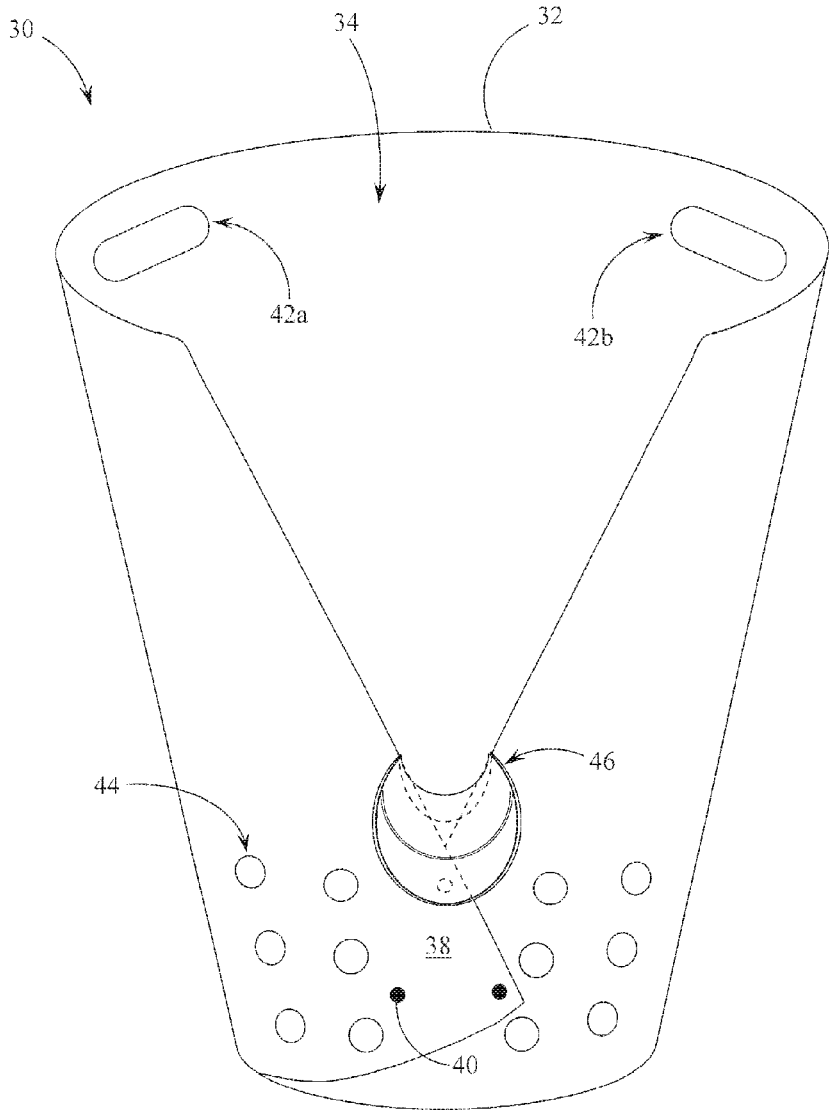
FIG. 6 is an isometric view of the front of an alternate preferred embodiment of the overspray shield and funnel device of the present invention, shown with an attachable drip cup positioned in the V-shaped access opening.

Reference is next made to FIG. 6 which is an isometric view of the front of an alternate preferred embodiment of the overspray shield and funnel device of the present invention, shown with an attachable drip cup positioned in the V-shaped access opening. The alternate or additional features include an array of apertures 44 cut through the flexible plastic sheet material 32 in the area around the base of the funnel. These apertures 44 allow water to flow into the cone from the toilet bowl when the toilet is flushed in a manner that would facilitate rinsing of the cone after use. The same apertures 44 also facilitate the rinsing of the funnel in a shower enclosure or the like to distribute water both inside and outside the walls of the funnel.

A further ancillary component that may be included with the overspray shield of the present invention is a removable cup 46. This saddle shaped cup may be positioned in the vertex of the V-shaped opening in the front facing side of the cone to collect any urine that may drip during use. The cup also provides the added benefit of covering the vertex of the V-shaped opening. As in the first preferred embodiment, handle cutouts 42*a* & 42*b* are positioned near the upper perimeter of the cone 30 to facilitate placement and removal of the device in the toilet.

Figure 8:
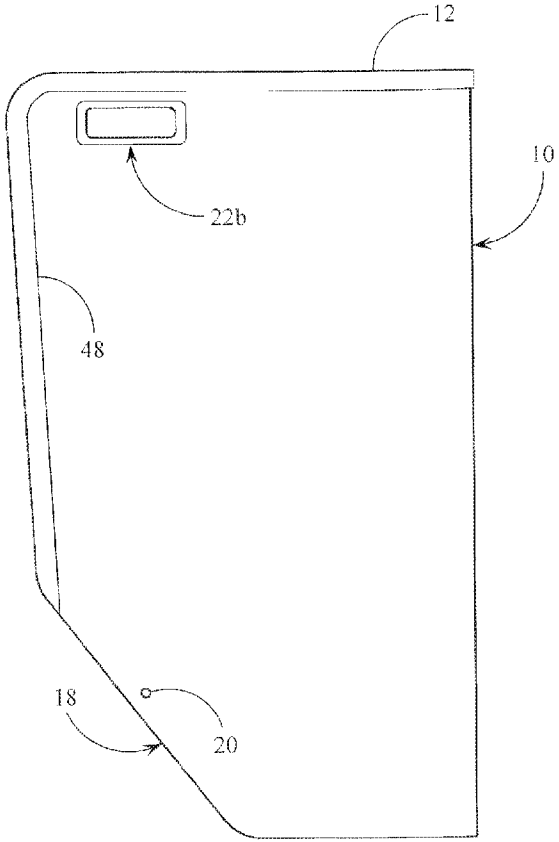
FIG. 8 is a side elevational view of an alternate embodiment of the overspray shield and funnel device of the present invention, shown with an edge cover in place.
Figure 7:
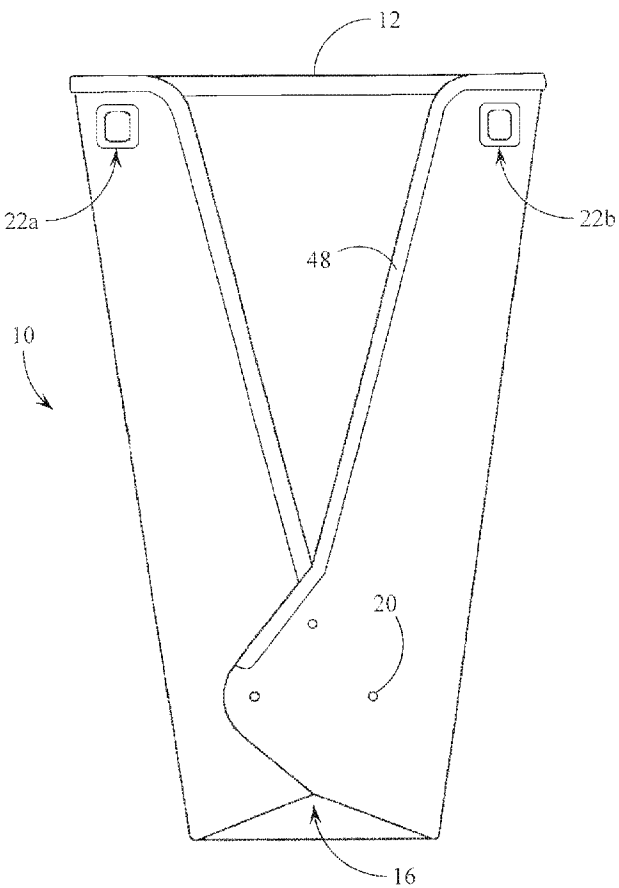
FIG. 7 is a front elevational view of an alternate embodiment of the overspray shield and funnel device of the present invention, shown with an edge cover in place.

Reference is finally made to FIGS. 7 & 8 which disclose a further embodiment of the present invention wherein some part of the exposed edge of the sheet or panel making up the walls of the funnel incorporate an edge cover. Overspray shield 10 is again shown as a large cone shaped device preferably constructed of a single plastic sheet 12 that is rolled into the cone shape shown and attached back onto itself near the lower end of the cone. This construction creates a wide top opening 14 and a narrower bottom opening 16 each of which have exposed edges. The edge forming the base is preferably left as is since there is little if any contact between the base and the user or handler of the device. The edge forming the top or upper end of the cone or funnel, however, as well as the edge forming the "V" shaped opening in the side wall of the funnel, is subject to contact by the user and/or the handler of the device. As a means of providing a smoother edge that potentially may come into contact with the user and/or handler of the device, the alternate embodiment shown in FIGS. 7 & 8 incorporates edge cover 48 over much of the edge of the panel that forms the upper portion of the funnel. Handle apertures 22*a* & 22*b*, again positioned near the top edge of the device, may also incorporate edge covers, as shown, to provide a smoother edge for the handler of the device to grasp. Each of the various optional features described above in conjunction with the first preferred embodiment may also be utilized and applied in conjunction with the alternate embodiment shown in FIGS. 7 & 8.

In the ideal environment, the device may be alternately maintained in the toilet or in an adjacent bathtub or shower where it may be rinsed in between uses. Once again, the goal of the invention is to create a simple, inexpensive to manufacture, structure that is highly functional and effective in containing urine overspray and directing it into the toilet bowl.

Although the present invention has been described in terms of the foregoing preferred embodiments, this description has been provided by way of explanation only, and is not intended to be construed as a limitation of the invention. Those skilled in the art will recognize modifications of the present invention that might accommodate specific individual needs (based on the individual user's abilities) or specific toilet configurations. While the device is flexible enough to accommodate toilet bowls (and/or toilet seats) that might vary in diameter and shape, it may be desirable to alter the geometry of the flat panel from which the cone shape is constructed so as to better fit certain toilet designs. Toilets are known, for example, to come in designs with oval seat opening having a long diameter only slightly larger than the short diameter, as well as designs with greatly elongated openings where the long diameter (typically front to back on the toilet seat) is significantly longer than the width diameter (side to side). Such modifications, where they are coincidental to the needs of the individual or the specific configuration of the toilet being used, do not necessarily depart from the spirit and scope of the invention.

We claim:

1. A toilet overspray shield for use with a toilet for standing urination, the toilet having a bowl presenting an open, generally elliptical rim, in a plane generally parallel with a support surface on which the toilet is positioned, the toilet overspray shield comprising:

a funnel comprising a funnel wall defining a partially open side, an upper semi-circular rim defining an inlet opening, and a lower circular rim defining an outlet opening, the funnel wall comprising a section of flexible polymer plastic panel, the polymer plastic panel comprising a top edge; a bottom edge; and two side edges; wherein the bottom edge and two side edges form first and second lower corners, and wherein the panel is curved back on itself to form a funnel shape such that the first lower corner at least partially overlaps the second lower corner and closes the bottom edge of the panel back on itself, whereby the closed bottom edge of the panel forms the lower circular rim defining the outlet opening of the funnel, and whereby the open top edge of the panel forms the upper semi-circular rim defining the inlet opening of the funnel, the partially open side of the funnel defined by the open top edge and the two side edges of the panel, the two side edges of the panel defining a "V" shaped opening, the vertex of the "V" shaped opening formed at the point of overlap between the first and second lower corners; and a perforated funnel wall portion proximate to the lower circular rim, the perforated funnel wall portion defining an array of apertures facilitating a flow of liquid out from inside the funnel;

wherein the lower rim of the funnel may be removably positioned within the generally elliptical rim of the toilet bowl to support the funnel upright with the outlet opening directed into the toilet bowl, and wherein the funnel may be oriented to position the partially open side to receive standing urination into the funnel.

2. The toilet overspray shield of claim 1 wherein the first lower corner of the polymer plastic panel is fixed to the second lower corner of the panel where the corners overlap using at least one non-corrosive attachment means extending through each of the lower corners of the panel.

3. The toilet overspray shield of claim 2 wherein the non-corrosive attachment means comprises a rivet.

4. The toilet overspray shield of claim 2 wherein the non-corrosive attachment means comprises a separable snap device.

5. The toilet overspray shield of claim 1 wherein the first lower corner of the polymer plastic panel is fixed to the second lower corner of the panel where the corners overlap with a thermal weld.

6. The toilet overspray shield of claim 1 wherein the first lower corner of the polymer plastic panel is fixed to the second lower corner of the panel where the corners overlap, with a chemical adhesive.

7. The toilet overspray shield of claim 1 wherein the funnel comprises a funnel wall handle portion proximate to the upper semi-circular rim, the funnel wall handle portion defining at least two apertures for at least partially receiving the hands of a user to facilitate the placement of the funnel into, and the removal of the funnel from, the toilet.

8. The toilet overspray shield of claim 1 wherein the funnel comprises a material incorporating one or more antimicrobial compositions.

9. The toilet overspray shield of claim 1 wherein the funnel comprises a material incorporating one or more deodorizing compositions.

10. The toilet overspray shield of claim 1 further comprising one or more edging cover components positioned on at least a portion of the upper semi-circular rim of the funnel wall and on at least a portion of the funnel wall edges defining the partially open side of the funnel.

11. A toilet overspray shield for use with a toilet for standing urination, the toilet having a bowl presenting an open, generally elliptical rim, in a plane generally parallel with a support surface on which the toilet is positioned, the toilet overspray shield comprising:

a funnel comprising a funnel wall defining a partially open side, an upper semi-circular rim defining an inlet opening, and a lower circular rim defining an outlet opening, the funnel wall comprising a flexible polymer plastic panel, the polymer plastic panel comprising a top edge; a bottom edge; and two side edges; wherein the bottom edge and two side edges form first and second lower corners, and wherein the panel is curved back on itself to form a funnel shape such that the first lower corner at least partially overlaps the second lower corner and closes the bottom edge of the panel back on itself, whereby the closed bottom edge of the panel forms the lower circular rim defining the outlet opening of the funnel, and whereby the open top edge of the panel forms the upper semi-circular rim defining the inlet opening of the funnel, the partially open side of the funnel defined by the open top edge and the two side edges of the panel, the two side edges of the panel defining a "V" shaped opening, the vertex of the "V" shaped opening formed at the point of overlap between the first and second lower corners; and a perforated funnel wall portion proximate to the lower circular rim, the perforated funnel wall portion defining an array of apertures facilitating a flow of liquid out from inside the funnel;

a plurality of attachment snaps fixed between the first and second lower corners of the polymer plastic panel in the area of overlap to allow for the attachment or detachment of the first and second lower corners together to alternately form the conical funnel or reduce the funnel wall to a flat panel configuration;

wherein when the funnel is configured for use by attachment of the first and second lower corners together using the plurality of attachment snaps, the lower circular rim of the funnel thus formed may be removably positioned within the generally elliptical rim of the toilet bowl to support the funnel upright with the outlet opening directed into the toilet bowl, and wherein the funnel may be oriented to position the partially open side to receive standing urination into the funnel.

* * * * *